US006523579B1

(12) United States Patent
Tham

(10) Patent No.: US 6,523,579 B1
(45) Date of Patent: Feb. 25, 2003

(54) METHOD OF MANUFACTURING AN INK JET PRINT CARTRIDGE AND INK JET PRINT CARTRIDGE MANUFACTURED USING THE SAME

(75) Inventor: Hing Ching Tham, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/068,820

(22) Filed: Feb. 6, 2002

(51) Int. Cl.[7] ..... B65B 1/04

(52) U.S. Cl. ..... 141/34; 141/2; 141/18; 347/87

(58) Field of Search ..... 141/2, 18, 20.5, 141/98, 34; 347/84, 85, 86, 87, 28

(56) References Cited

U.S. PATENT DOCUMENTS 5,874,978 A 2/1999 Swanson et al.
6,042,225 A 3/2000 Altendorf et al.

*Primary Examiner*—Steven O. Douglas

(57) ABSTRACT

A method of manufacturing an ink jet print cartridge is disclosed. The method includes fabricating a vented foam-filled type or a spring-bag type cartridge. The method also includes introducing ink into a reservoir. For a foam-filled cartridge, the method further includes covering orifices of an orifice plate to prevent leakage of ink through the orifices and subjecting the cartridge to a predetermined centrifugal force to force ink into a standpipe chamber to displace air trapped therein. For a spring-bag type cartridge, the method further includes subjecting the cartridge to a predetermined centrifugal force to force ink away from a standpipe chamber to displace air in a reservoir to force the air to collect adjacent a standpipe and priming the cartridge by drawing the air out of the cartridge through orifices of an orifice plate. A print cartridge manufactured according to the above method is also disclosed.

14 Claims, 8 Drawing Sheets

METHOD OF MANUFACTURING AN INK JET PRINT CARTRIDGE AND INK JET PRINT CARTRIDGE MANUFACTURED USING THE SAME

BACKGROUND

This invention relates generally to a method of manufacturing a thermal ink jet (TIJ) print cartridge and a TIJ print cartridge manufactured using the method. More particularly, this invention relates to a method of filling an ink reservoir of a TIJ print cartridge with ink in a manner so as to reduce the amount of air trapped in a standpipe chamber of the TIJ print cartridge.

Thermal ink jet (TIJ) technology is widely used in today's printers. Very generally, a TIJ print cartridge includes a TIJ printhead that has an orifice plate attached to a printhead die. Orifices or nozzles in the orifice plate are aligned with transducers on the printhead die. The transducers are selectively actuatable to eject droplets of ink through the corresponding nozzles onto a print medium. U.S. Pat. No. 5,874,978 discloses one such TIJ print cartridge. The cartridge further includes an ink reservoir for storing ink. A standpipe that defines a standpipe chamber connects and allows ink from the ink reservoir to flow to the printhead. A screen filter is disposed at the entrance of the standpipe chamber to prevent particulate contaminants in the ink from reaching and clogging the printhead.

During manufacturing, the print cartridge is primed by vacuuming air out of the standpipe chamber to remove air trapped therein. However, priming is unable to remove the trapped air entirely. Furthermore, over time a diffusion phenomenon results in air from outside the standpipe chamber penetrating the screen filter to increase the overall amount of air trapped in the standpipe chamber. Air is further introduced in the standpipe chamber during operation of the print cartridge. During operation, cool ink is drawn into the standpipe chamber and is warmed as the ink flows toward the printhead. The printhead generates heat as its resistors are activated or fired to eject droplets of ink from the nozzles. For a primarily water-based ink, the solubility of air decreases as the ink is heated. As a result, air is driven out of the ink, and diffuses into any preexisting air bubbles in the standpipe chamber. Over time, the standpipe chamber may be filled with sufficient air to restrict the proper flow of ink into the standpipe chamber. Printing under such conditions of the print cartridge results in print defects. This increase in air in the standpipe chamber occurs both in vented foam-filled print cartridges as well as print cartridges using a spring-bag type of backpressure mechanism.

As the amount of air increases in the standpipe, there will come a time when the trapped air causes complete ink starvation or depriming of the printhead to render the print cartridge useless. The amount of air left in a print cartridge when it leaves the production line has an effect on the overall useful life of the print cartridge.

There is also a disadvantage associated with priming of a print cartridge. Priming causes both air and ink to be vacuumed out of the print cartridge. The ink that is vacuumed out of the print cartridge is not reused because of it typically contains more contaminants.

SUMMARY

According to an aspect of the present invention, there is provided a method of manufacturing an ink jet print cartridge. The method includes fabricating a cartridge. The cartridge includes a body that supports a printhead. The printhead includes an orifice plate having orifices formed therethrough. The cartridge includes an ink reservoir with a backpressure mechanism and at least one standpipe defining a stand pipe chamber for delivering ink from the reservoir to the printhead. A filter is disposed adjacent the chamber for preventing contaminants in the ink from reaching the printhead. The method further includes introducing ink into the reservoir, covering the orifices of the orifice plate to prevent leakage of ink through the orifices, and subjecting the cartridge to a predetermined centrifugal force to force ink into the standpipe chamber to displace air trapped therein.

According to another aspect of the present invention, there is an ink jet print cartridge manufactured according to the above-mentioned method.

According to yet another aspect of the present invention, there is provided a method of manufacturing another ink jet print cartridge. The method includes fabricating the cartridge. The cartridge includes a body that supports a printhead. The printhead includes an orifice plate having orifices formed therethrough. The cartridge further includes an ink reservoir with a back pressure device disposed therein and a standpipe defining a standpipe chamber for delivering ink from the reservoir to the printhead. A filter is disposed adjacent the standpipe chamber for preventing contaminants in the ink from reaching the printhead. The method further includes introducing ink into the reservoir and subjecting the cartridge to a predetermined centrifugal force to force ink away from the standpipe chamber to displace air in the reservoir to force the air to collect adjacent the standpipe. The method also includes priming the cartridge by drawing the air out of the cartridge through the orifices.

BRIEF DESCRIPTION OF DRAWINGS

The invention will be better understood with reference to the drawings, in which.

DETAILED DESCRIPTION

Figure 1:
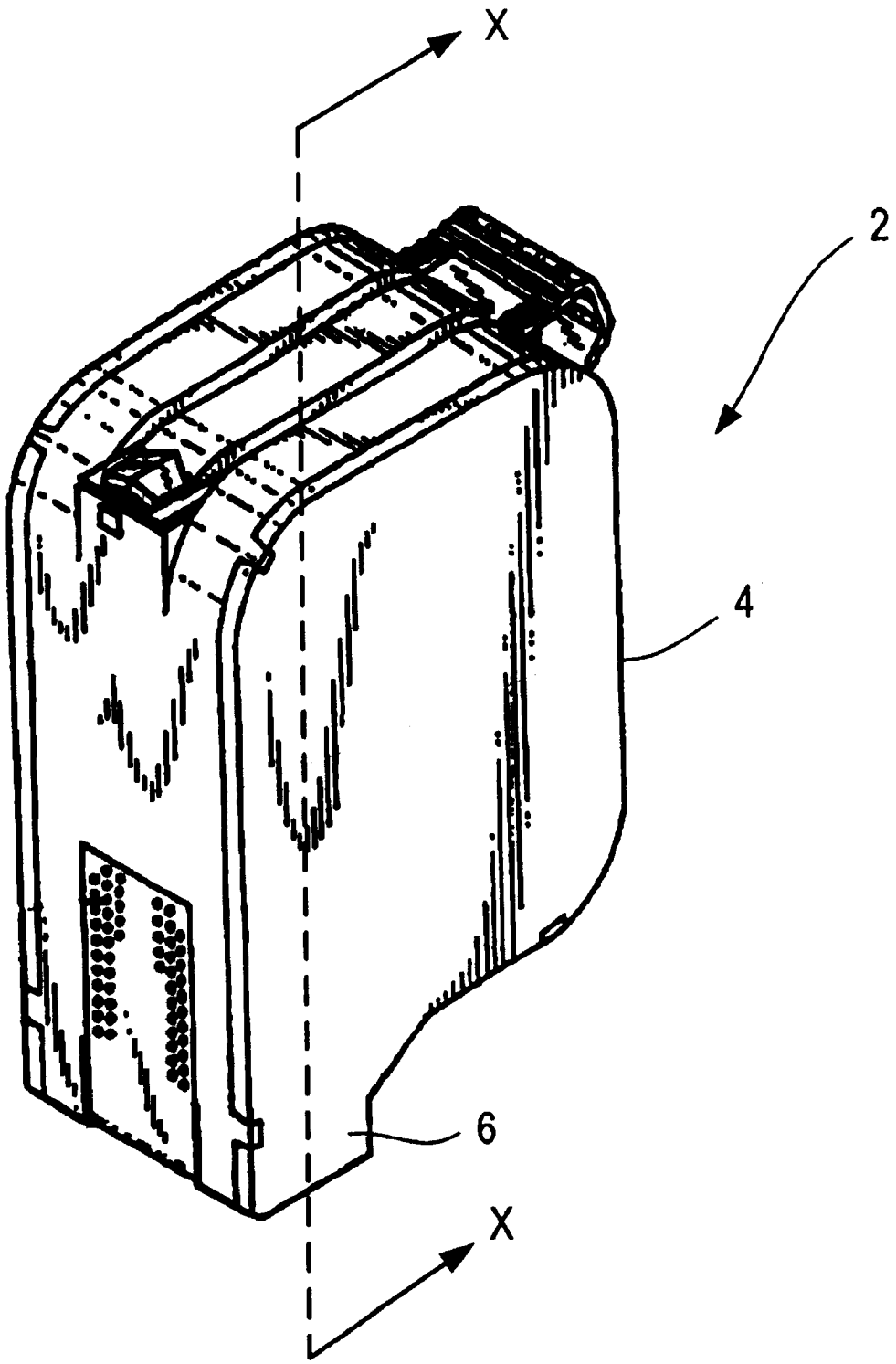
FIG. 1 is an isometric drawing of a multi-chamber vented foam-filled ink jet print cartridge.
Figure 2:
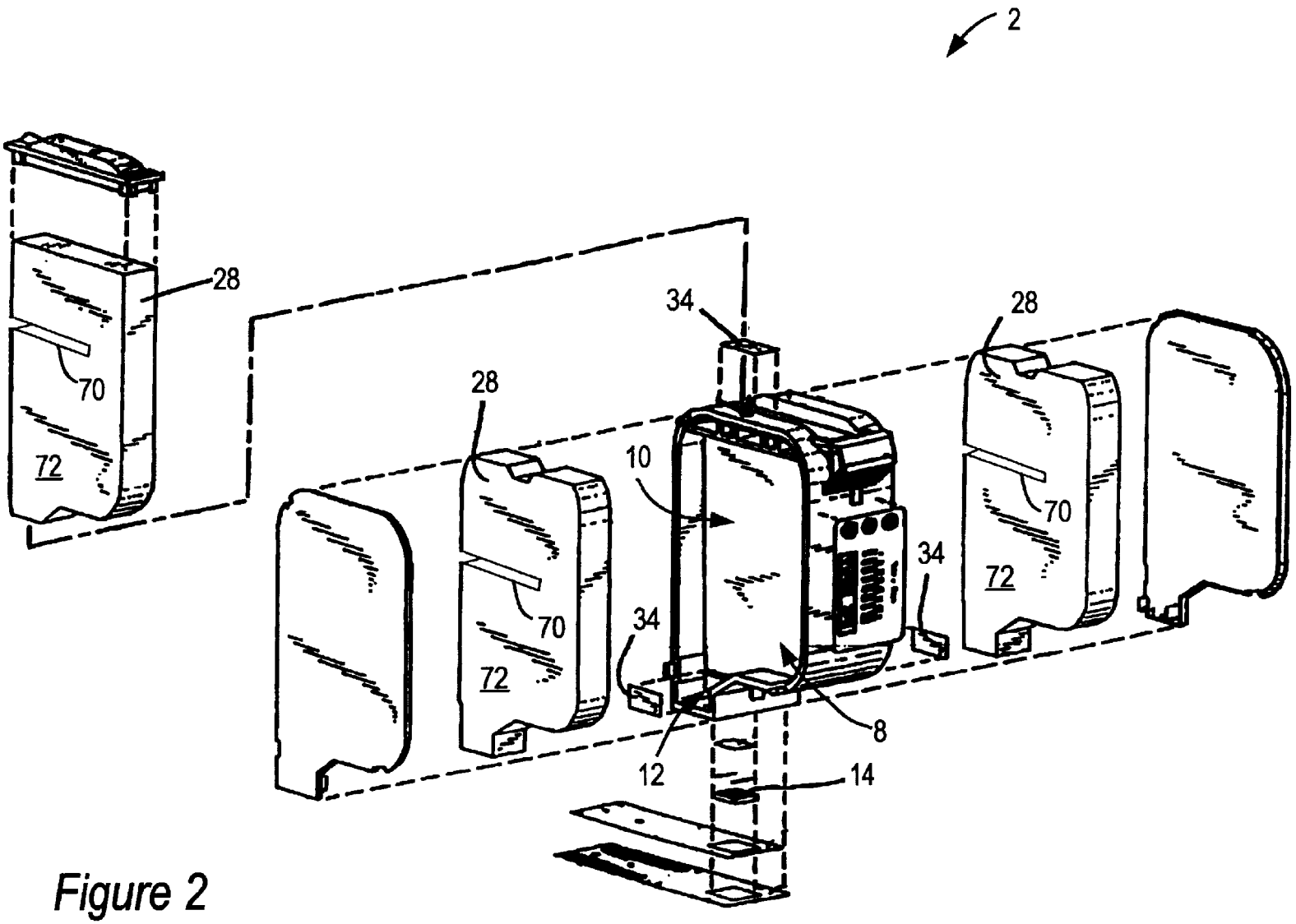
FIG. 2 is a perspective exploded drawing of the print cartridge in FIG. 1.
Figure 3:
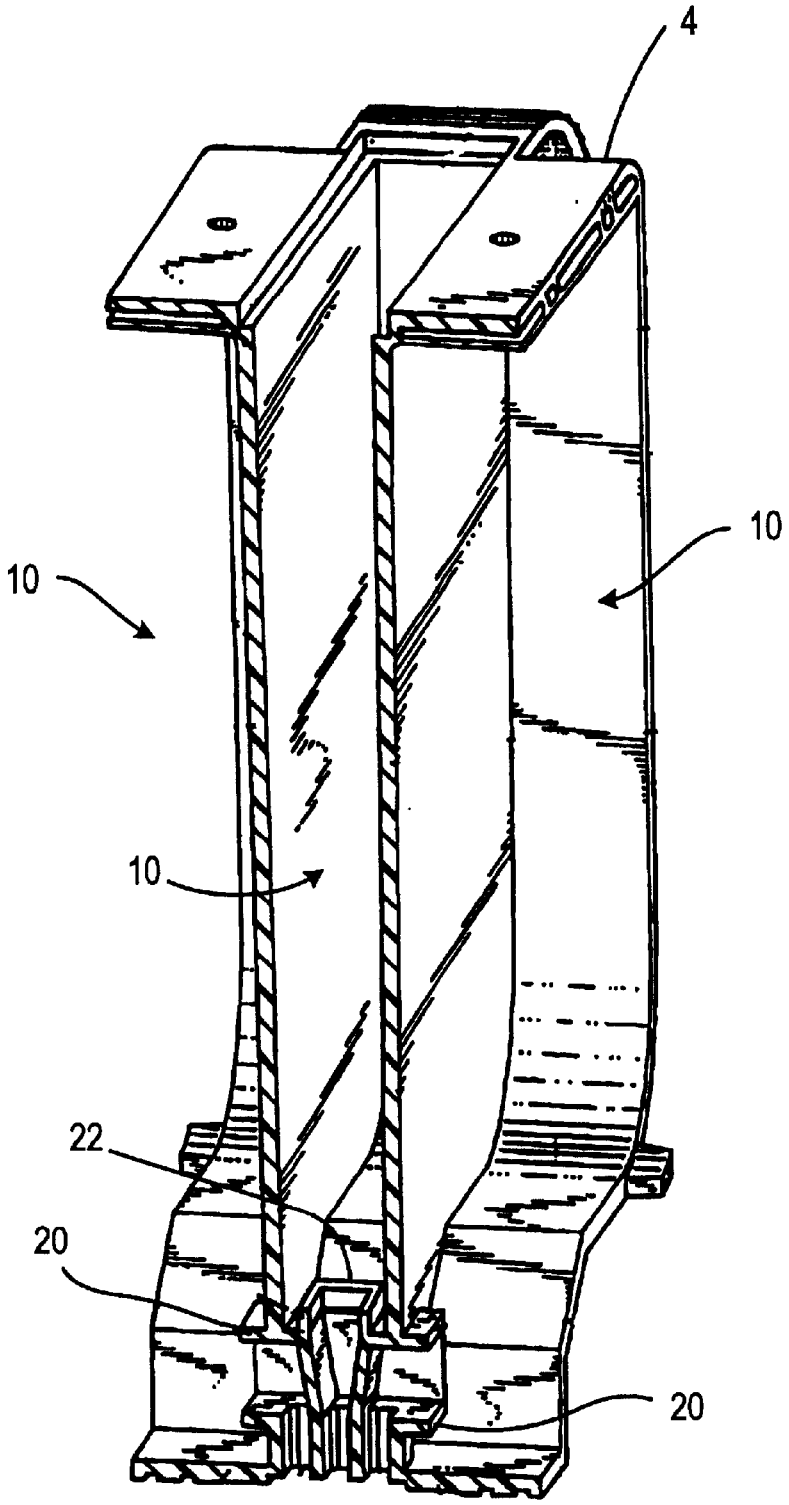
FIG. 3 is a sectional perspective drawing of a main portion of the print cartridge in FIG. 1 taken along a line X—X in FIG. 1, showing a center standpipe chamber and two outer standpipe chambers.
Figure 4:
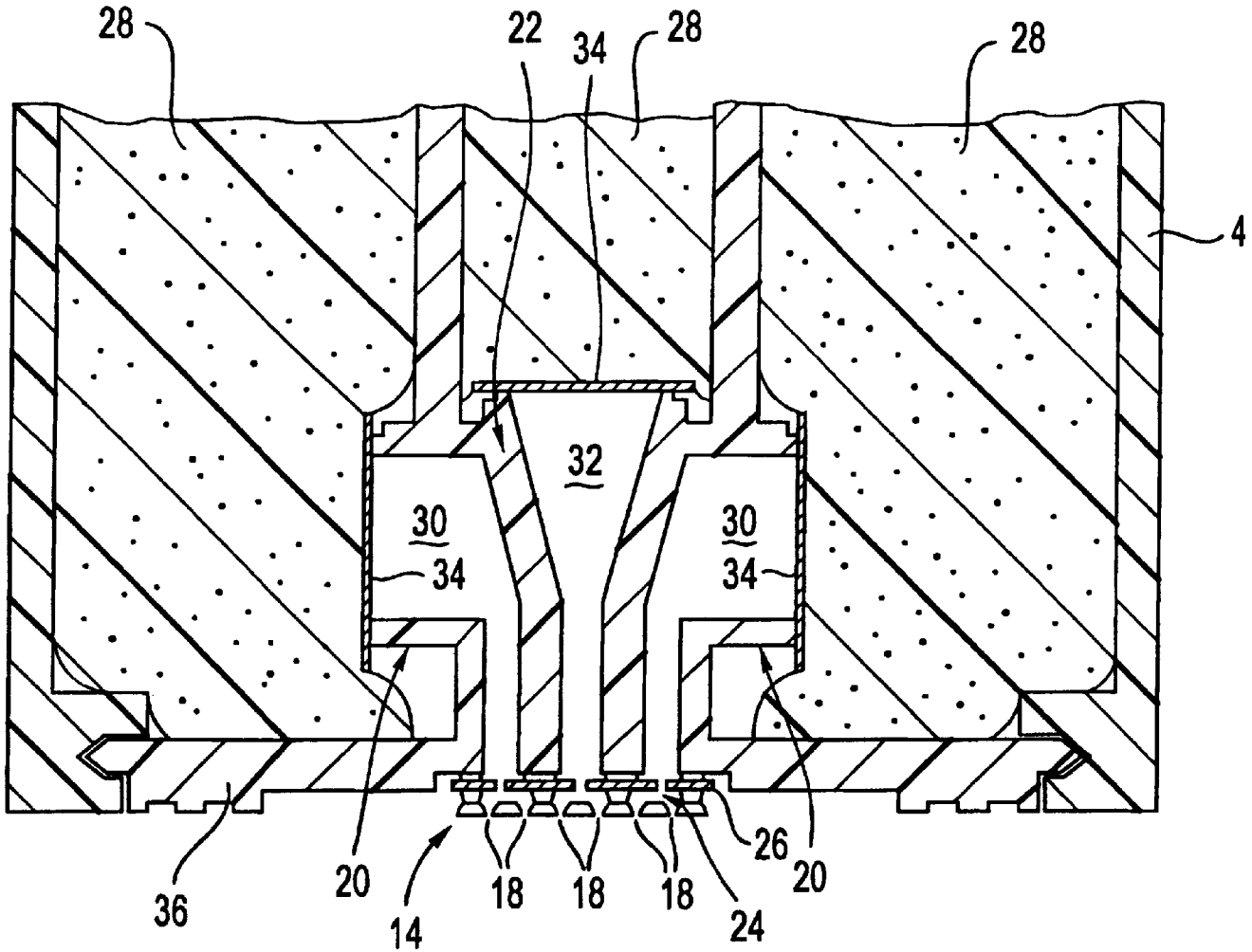
FIG. 4 is a side elevation of the print cartridge in FIG. 1, shown in section and partially cut away.

FIG. 1 shows an isometric drawing of a multi-chamber ink jet print cartridge 2 for containing three primary colors of ink. FIG. 2 is an exploded drawing of the print cartridge 2. The print cartridge 2 includes a body 4 having a snout 6. Each color of ink is contained in a separate chamber 8 within the body 4. Each chamber 8 includes a reservoir 10 and a snout portion 12. The snout 6 supports a printhead 14 having an orifice plate 16 (FIG. 4). Formed in the orifice plate 16 are separate groups of nozzles 18 for ejecting droplets of each color of ink. Each color of ink contained in the reservoir 10 is ducted to its respective group of nozzles 18 through a respective ink pipe or standpipe 20, 22 so that the inks do not mix within the print cartridge 2. The inks in the print cartridge 2 are held in their respective reservoirs 10 at less than atmospheric pressure so that the inks do not drool out of the nozzles 18 when the print cartridge 2 is not in use. This negative relative pressure, or back pressure, must not be so great that air is gulped into firing chambers 24 defined between the orifice plate 16 and a printhead die 26 of the printhead 14. Air trapped in the firing chambers 24 causes the firing chambers 24 to "deprime". Such depriming of the firing chambers 24 renders the print cartridge 2 no longer able to function properly. Various mechanisms have been devised to provide the appropriate backpressure. In the print cartridge 2, a porous material, such as synthetic foam 28, is used in each chamber 8 to receive and retain the ink at the appropriate backpressure by capillary action.

Specifically, each of the standpipes 20, 22 has a standpipe chamber 30, 32 through which the inks flow from the respective reservoirs 10 to the printhead 14. At the entrance of each standpipe chamber 30, 32 is a screen filter 34 for preventing contaminants in the inks from reaching the printhead 14. The standpipes 20, 22 press against the foams 28 to increase the capillarity of the foams 28 adjacent the standpipes 20, 22. The screen filters 34 also serve to assist in this compression. In the print cartridge 2, only one of the three standpipes 20, 22, the center standpipe 22, extends upwardly away from a bottom wall 36 of the print cartridge body 4. The other two outer standpipes 20 extend laterally.

Information regarding structural details, operation and the method of manufacturing such a print cartridge 2 is found in U.S. Pat. No. 6,042,225, Altendorf, entitled Ink-Jet Pen with One-piece Pen Body.

Figure 5:
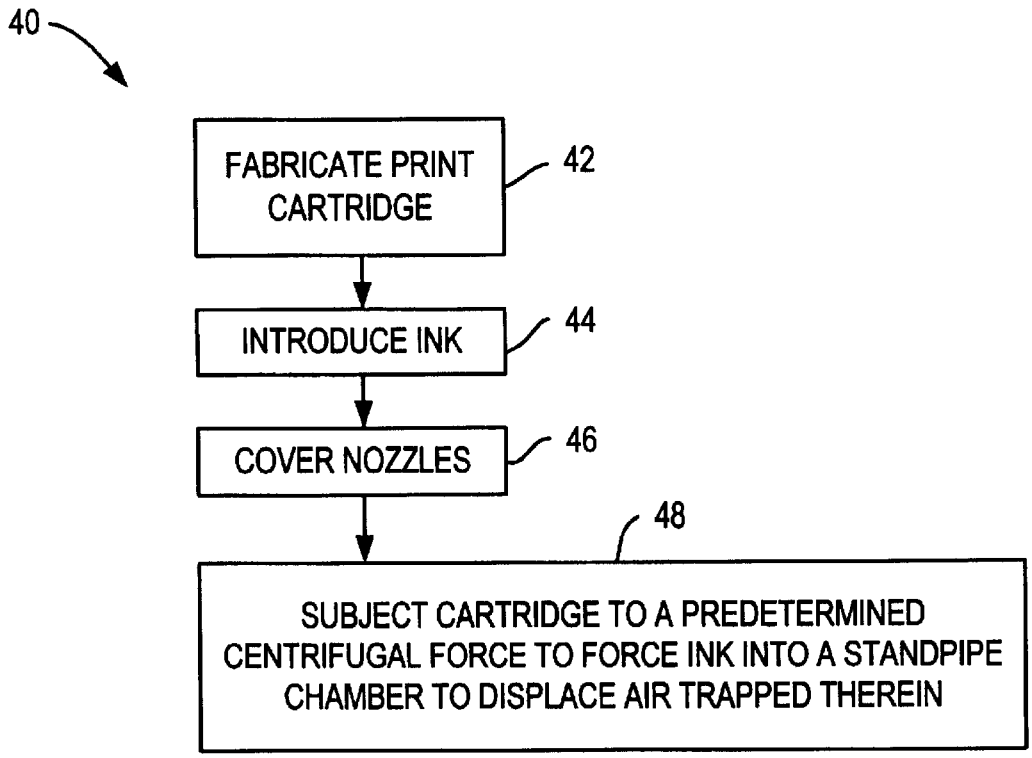
FIG. 5 is a flowchart showing a sequence of steps for manufacturing the print cartridge in FIG. 1.

FIG. 5 is a flow chart showing a first sequence 40 of steps according to an embodiment of the present invention for manufacturing the print cartridge 2.

The sequence 40 starts in a FABRICATE PRINT CARTRIDGE step 42, wherein the print cartridge 2 is fabricated using any known method, such as the one described in detail in U.S. Pat. No. 6,042,225. The sequence 40 proceeds to an INTRODUCE INK step 44, wherein the reservoirs 10 of the print cartridge 2 are filled with ink of different colors.

Figure 6:
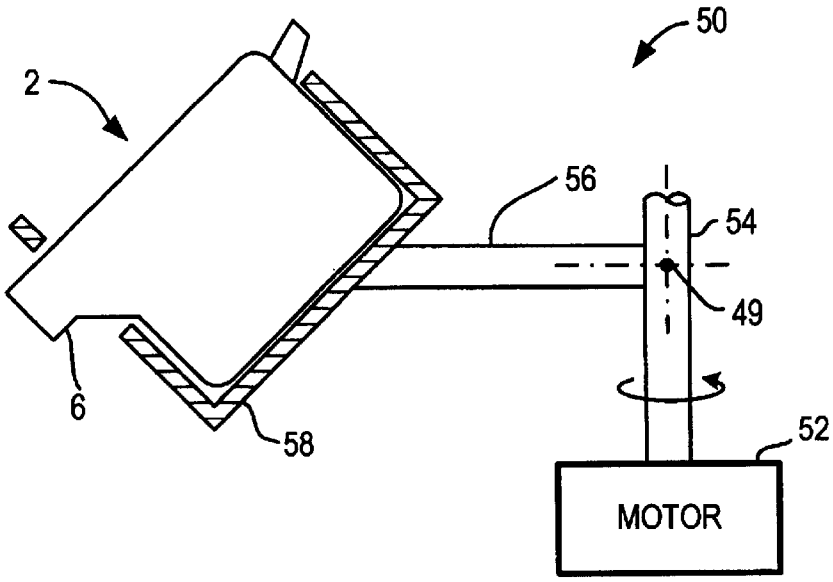
FIG. 6 is a drawing showing apparatus for supporting the print cartridge in FIG. 1 at a predetermined position and subjecting the print cartridge to a predetermined centrifugal force according to a step in FIG. 5.

The sequence 40 next proceeds to a COVER NOZZLES step 46, wherein a piece of tape or any other suitable means is used to cover the group of nozzles 18 of the orifice plate 16 to prevent leakage of ink through the nozzles 18. Thereafter, the sequence 40 ends in a step 48, wherein the print cartridge 2 is subjected to a predetermined centrifugal force to force the inks into the respective standpipe chambers 30, 32 to displace air trapped therein. In this step 48, the print cartridge 2 is supported a predetermined distance from a central point 49 (FIG. 6) with an end of the body 4 that supports the printhead 14, in this case the snout 6 end, further away from the central point 49. FIG. 6 shows an example of apparatus 50 that may be used to implement this step 48. The apparatus 50 includes a motor 52 and a shaft 54 fixed to a rotor (not shown) of the motor 52. Mounted on the shaft is a plurality of radially extending arms 56, one of which is shown in FIG. 6. Fixed to the distal end of each arm 56 is a bucket 58 for supporting a print cartridge 2. The motor 52 is driven to rotate the print cartridge 2 at a predetermined speed about the shaft 54 for a predetermined period to force the inks into the respective standpipe chambers 30, 32. Air bubbles trapped in the standpipe chambers 30, 32 may be displaced by the ink to escape through the screen filters 34. Typically the speed of the motor should be sufficient to generate a G-force of about 200–1100 G for about 15–30 seconds to exert sufficient pressure on the air to allow the air to escape through the screen filters.

Figure 7:
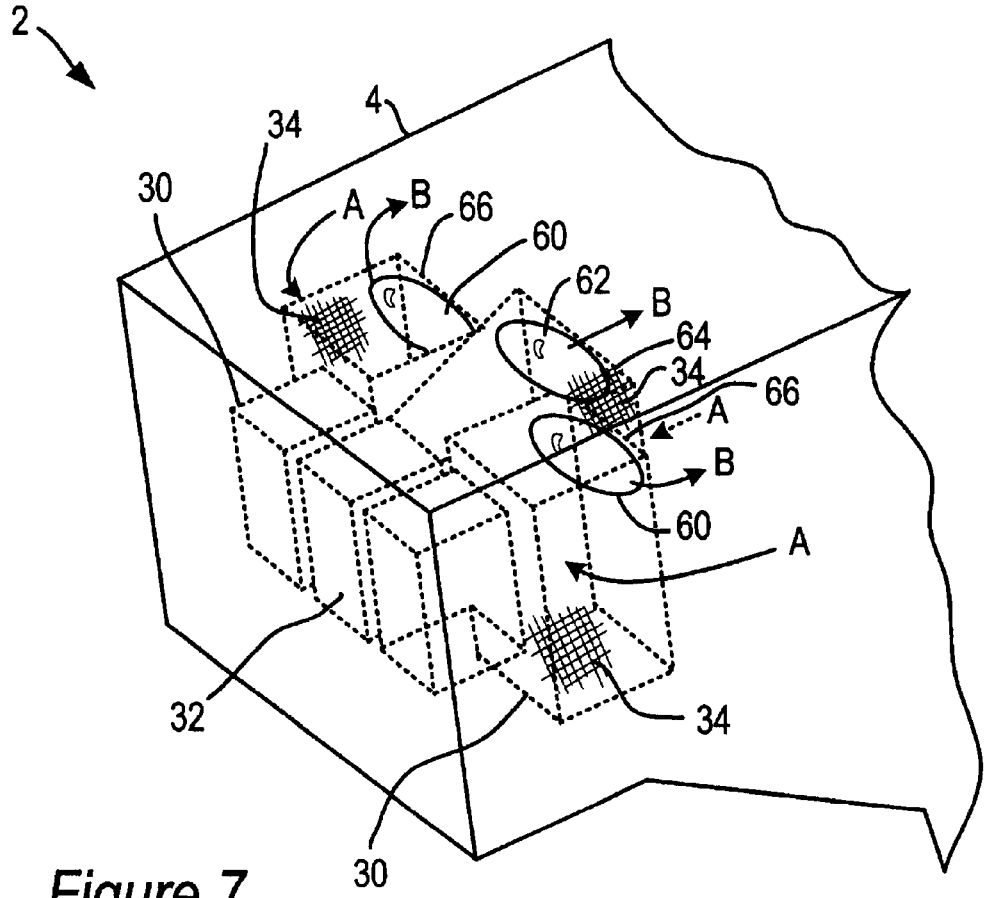
FIG. 7 is an isometric drawing of a portion of the print cartridge held in the predetermined position in FIG. 6 showing air bubbles in the standpipe chambers urged to selected portions thereof.

Preferably, the print cartridge 2 is supported in a predetermined position for rotation. This predetermined position allows rotation of the print cartridge 2 to force ink into the standpipe chambers 30, 32 so that air in the standpipe chambers 30, 32 is urged towards a selected portion of the standpipe chambers 30, 32 to facilitate its escape through the screen filters 34. One such predetermined position for the print cartridge 2 is that defined by dipping the snout end of print cartridge 2 by an angle of about 45° as shown in FIG. 6. FIG. 7 is a drawing showing air bubbles 60, 62 being urged to portions of the standpipe chambers 30, 32 when the print cartridge 2 is supported for rotation in the position shown in FIG. 6. Ink flows into the standpipe chambers 30, 32 in directions according to arrows A, whereas air bubbles 60, 62 escape from the standpipe chambers 30, 32 in opposite directions to the flow of ink according to arrows B. It is to be noted that the air bubble 62 is urged against an edge 64 of the standpipe chamber 32 that is flanked on one side by the screen filter 34. The air bubble 62 is therefore able to easily escape through the screen filter 34. In the two outer standpipe chambers 30, air bubbles 60 are urged against an edge 66 flanked on both sides by standpipe walls. The air bubbles 60 can escape laterally through the side screen filters 34 when they grow to a certain size to impinge on the screen filters 34.

Figure 8A:
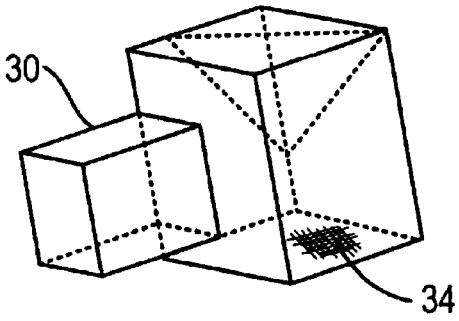
FIGS. 8A and 8B are isometric drawings of a portion of an outer standpipe chamber showing walls modified to enhance the purging of air from the standpipe chamber.
Figure 8B:
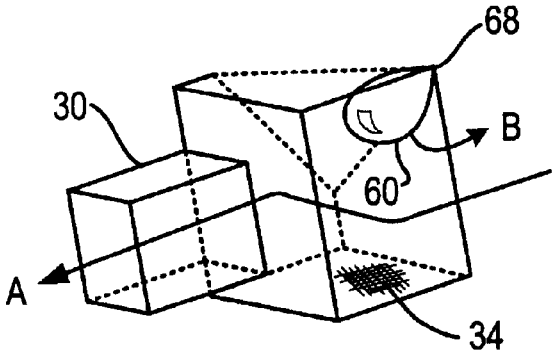

To allow air to more easily escape from the two outer standpipe chambers 30, the standpipe walls may be modified as shown in FIG. 8A to shape the standpipe chamber 30 as shown in FIG. 8B. Such a modified standpipe chamber 30 does not trap air but guide the air bubbles 60 into a corner 68 of the standpipe chamber 30 against the screen filter 34. toward the standpipes 20, 22 tends to back flow into the reservoirs 10. Preferably, to retard or prevent such back flow of ink, a gap 70 (FIG. 2) of a width of about 0.5 mm may be formed in each of the foams 28 to cordon off portions 72 of the foams adjacent the standpipes 20, 22. The position of the gap 70 is selected to define sufficiently large sized foam portions 72 to retain the amount of ink introduced in the reservoirs 10.

It should be noted that priming is not required for such a vented foam-filled print cartridge 2 that is subjected to the centrifugal force according to the step 48.

Figure 9:
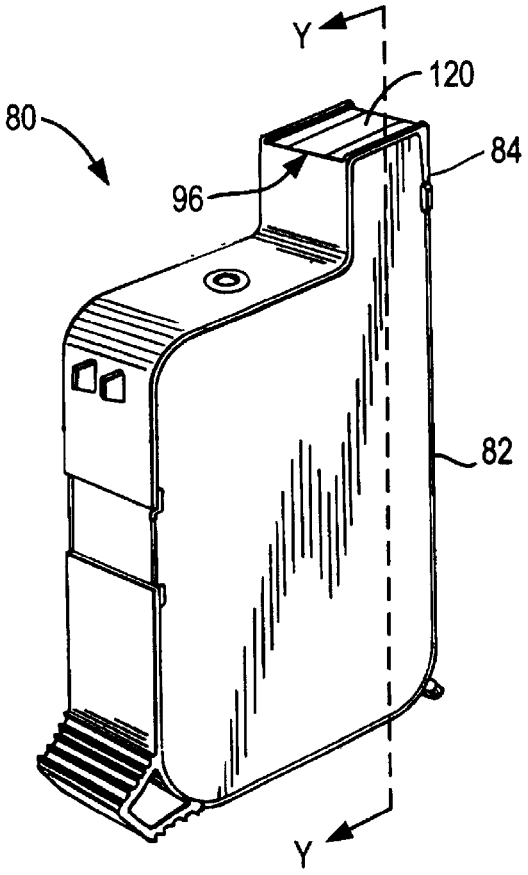
FIG. 9 is an isometric drawing of a spring-bag type print cartridge.
Figure 10:
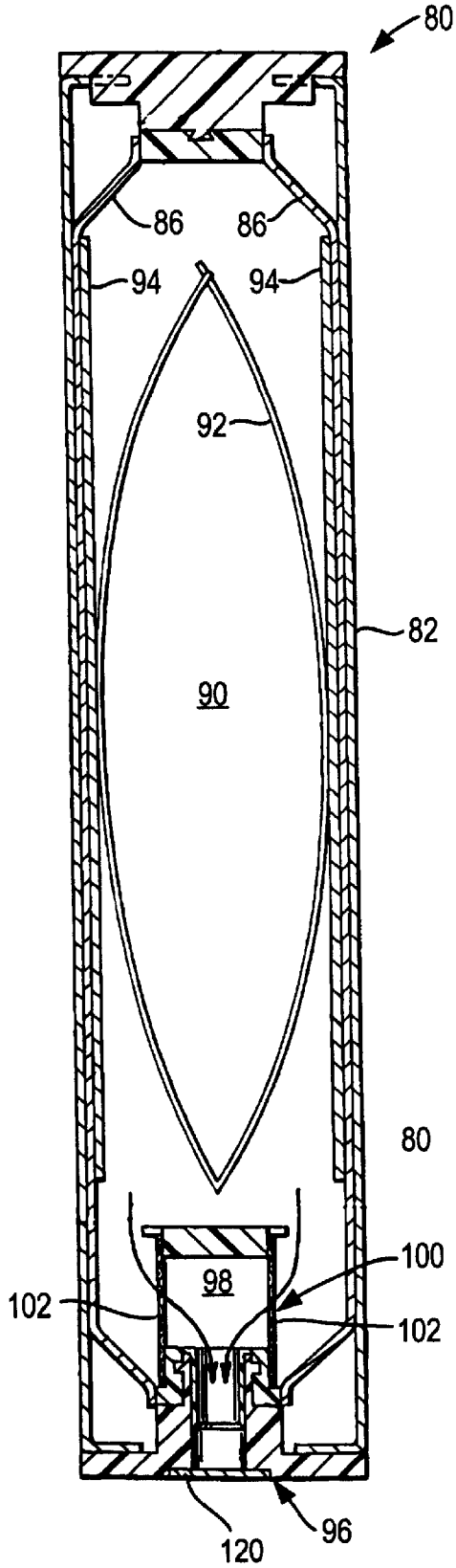
FIG. 10 is an sectional drawing of the print cartridge taken along line Y—Y in FIG. 9.

FIG. 9 shows a second print cartridge 80 that uses a spring-bag to generate the necessary backpressure required in the print cartridge 80. FIG. 10 is a sectional drawing of the print cartridge 80 taken along a line Y—Y in FIG. 9. The print cartridge 80 includes a body 82 having a snout 84. The print cartridge 80 has first and second impervious membranes 86, 88 attached to the interior of the body 82 to form a bag or ink reservoir 90 for holding a supply of ink. The print cartridge 80 includes a spring 92 which applies a separating force against two opposing plates 94 inside the ink reservoir 90 to separate the membranes 86, 88. The spring 92 and plates 94 maintain negative pressure on the ink in the reservoir 90 to keep the ink from drooling from a printhead 96. As ink is consumed form the reservoir 90, atmospheric pressure on the membranes 86, 88 result in compression of the spring 92 with the plates 94 drawn toward each other. Ink is drawn from the reservoir 90 through a standpipe chamber 98 defined by a standpipe 100 to the printhead 96. The membranes 86, 88 extend over the standpipe region to maintain the sealing of the membranes 86, 88 along the periphery of the snout region. A pair of screen filters 102 is disposed at the entrance of each side of the standpipe 100. The screen filters 102 include a finely woven stainless steel mesh. The mesh has a nominal passage dimension of 15 microns between adjacent mesh strands, and has a typical thickness of less than 0.005 inches. The screen filters 102 prevent particulate contaminants in the ink from reaching and thereby clogging the printhead 96. The mesh passage size is sufficiently small that, while ink may pass through the passages of the mesh, air bubbles under normal atmospheric pressure will not pass through the mesh passages which are wetted by the ink. The structural details, operation and method of manufacturing such a print cartridge 80 is described in U.S. Pat. No. 5,874,978, Swanson, entitled Method for Filling and Fabricating Ink Jet Cartridge.

Figure 11:
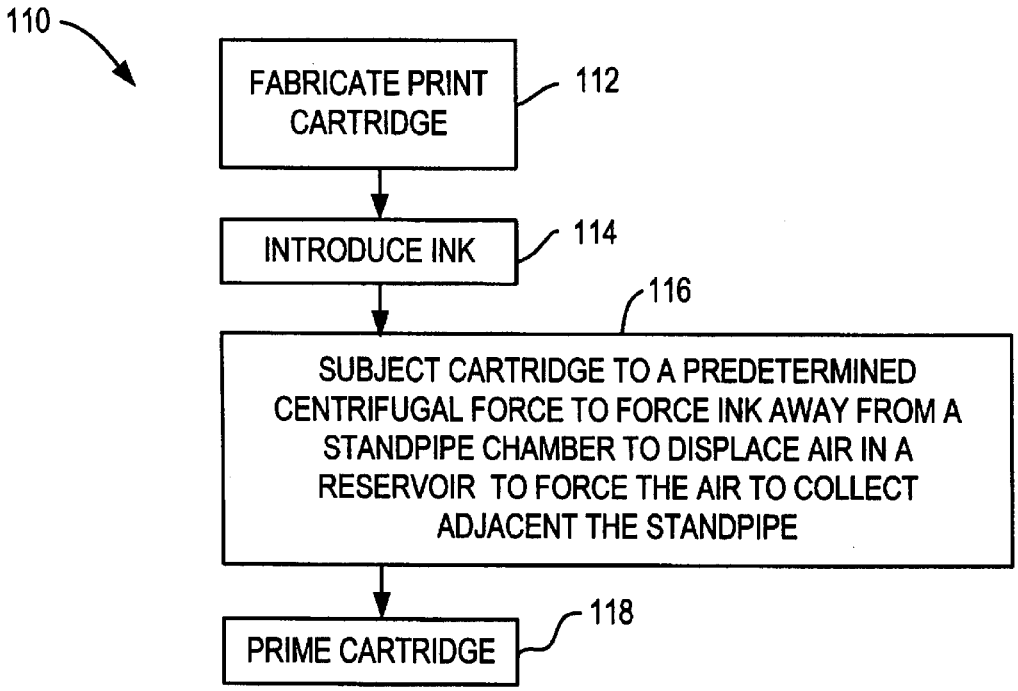
FIG. 11 is a flowchart of a sequence of steps of manufacturing the print cartridge in FIG. 9.

FIG. 11 shows a second sequence 110 of steps according to another embodiment of the present invention for manufacturing the second print cartridge 80. The sequence 110 starts in a FABRICATE INK CARTRIDGE step 112, wherein the print cartridge 80 is fabricated using any known method, such as the one described in detail in U.S. Pat. No. 5,874,978. The sequence 110 proceeds to an INTRODUCE INK step 114, wherein ink is introduced into the reservoir 90 of the print cartridge 80.

The sequence 110 next proceeds to a step 116, wherein the print cartridge 80 is subjected to a predetermined centrifugal force to force the ink into the reservoir 90 to displace any air trapped therein to force the air to collect adjacent the standpipe 100. More specifically, in this step 116, air bubbles in and adjacent the ink disintegrate and collect as air adjacent the standpipe 100 to define a relatively clear air-ink interface. The apparatus in FIG. 6 may be used to implement this step. Typically the speed of the motor 52 should be sufficient to generate a G-force of about 200–1100 G for about 15–30 seconds. Preferably, the sequence 110 further includes decelerating the print cartridge 80 to gradually bring the print cartridge 80 to rest.

The sequence 110 ends in a PRIME CARTRIDGE step 118, wherein the air collected around the standpipe 100 is vacuumed out of the print cartridge 80 through nozzles (not shown) of an orifice plate 120 of the printhead 96. The disintegration of the air bubbles in the step 116 facilitates priming.

Figure 12A:
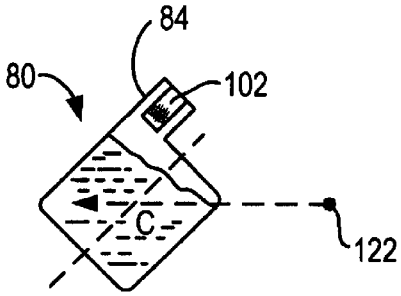
FIGS. 12A and 12B are drawings showing the location of ink in the print cartridge in FIG. 9 when the print cartridge is subjected to a predetermined centrifugal force and when the print cartridge is at rest respectively.
Figure 12B:
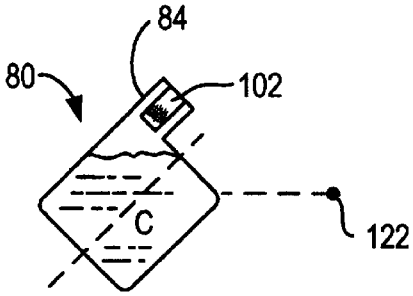

Preferably, the print cartridge 80 is supported in a predetermined position to allow rotation of the print cartridge 80 to force ink away from the standpipe 100 to be clear of the screen filters 102. One such predetermined position for the print cartridge 80 is that defined by tilting the print cartridge 80 by about 45° with an end of the body 82 that supports the printhead 96, in this case the snout end, facing upwards and closer to a center point 122 of rotation as shown in FIGS. 12A and 12B. FIG. 12A shows the location of ink in the reservoir 90 when the print cartridge 80 is subjected to a centrifugal force indicated by an arrow C. FIG. 12B shows the level of the ink when the print cartridge is no longer subjected to a centrifugal force but is brought to rest. Preferably, when bringing the print cartridge 80 to rest, the screen filters 102 are kept as dry as possible by avoiding contact with the ink. A dry screen filter 102 or one that is less wet facilitates the priming of the print cartridge in the PRIME CARTRIDGE step 118.

Figure 13A:
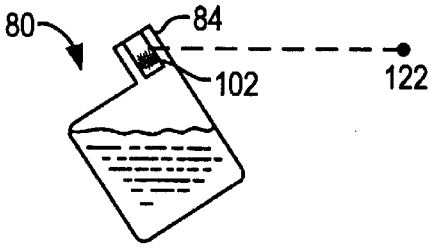
FIGS. 13A and 13B are drawings showing positions of the print cartridge in FIG. 9 that is pivotably mounted when at rest and when subjected to a centrifugal force.
Figure 13B:
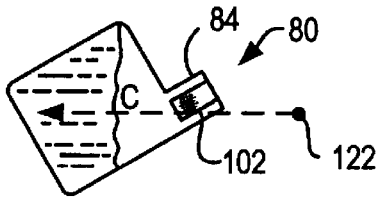

Alternatively, the print cartridge 80 may be supported to be pivotably mounted as shown in FIGS. 13A and 13B. FIG. 13A shows the rest position of the print cartridge 80 when it is at rest. FIG. 13B shows the print cartridge 80 in an outwardly extending position when it is subjected to a centrifugal force in the step 116. The centrifugal force causes the print cartridge 80 to swing away from the center point 122 to the outwardly extending position. When the centrifugal force is removed, the print cartridge 80 tilts back to its rest position as shown in FIG. 13A.

Advantageously, the method of manufacturing a print cartridge according to the embodiments of the present invention reduces the amount of air in the standpipes of the different print cartridges. In the case of the vented foam-filled print cartridges, priming is redundant and is no longer required. Without priming, there is no wastage of ink. Experimental results have shown that the shelf life of a print cartridge can be extended with such a method of manufacturing a print cartridge. This method further allows vented foam-filled print cartridges to be partially filled with ink. When subjected to the centrifugal force, the ink will be driven towards to be close to the standpipe of the print cartridge to allow the ink to be more easily drawn towards the printhead.

Although the present invention is described in the context of two types of print cartridges, the invention may be practiced on other types or variations of the print cartridges. For example, it is not necessary that the invention be practiced on print cartridges using a foam-filled or spring bag backpressure mechanism, the invention can also be practiced on print cartridges using other types of backpressure mechanisms. The invention may also be practiced on both top or side shooter type of print cartridges, print cartridges using transducers other than resistors, such as piezoelectric tranducers; and print cartridges using screen filters of a random fiber material. The print cartridges may also be subjected to a centrifugal force by flicking the print cartridges in an appropriate manner instead of rotating them.

I claim:

1. A method of manufacturing an ink jet print cartridge, the method comprising:

fabricating a cartridge including:

a body;

a printhead supported by the body, the printhead including an orifice plate having orifices formed therethrough;

an ink reservoir with a backpressure mechanism;

at least one standpipe defining a standpipe chamber for delivering ink from the reservoir to the printhead; and a filter adjacent the chamber for preventing contaminants in the ink from reaching the printhead;

introducing ink into the reservoir;

covering the orifices of the orifice plate to prevent leakage of ink through the orifices; and subjecting the cartridge to a predetermined centrifugal force to force ink into the standpipe chamber to displace air trapped therein.

2. A method according to claim 1, wherein subjecting the cartridge to a predetermined centrifugal force includes:

supporting the cartridge a predetermined distance from a central point with an end of the body that supports the printhead further away from the central point; and rotating the cartridge at a predetermined speed about the central point for a predetermined period to force ink into the chamber so that air in the standpipe chamber is urged against the filter to escape through the filter.

3. A method according to claim 2, wherein supporting the cartridge includes supporting the cartridge in a predetermined tilted position to allow rotating the cartridge to force ink into the standpipe chamber so that air in the standpipe chamber is urged towards an edge of the standpipe chamber flanked by the filter to escape through the filter.

4. A method according to claim 2, wherein supporting the cartridge includes supporting the cartridge in a predetermined tilted position to allow rotating the cartridge to force ink into the standpipe chamber so that air in the standpipe chamber is urged towards a corner of the standpipe chamber flanked by the filter to escape through the filter.

5. A method according to claim 1, wherein the predetermined centrifugal force is in a range of about 200–1100 G.

6. A method of manufacturing an ink jet print cartridge, the method comprising:

fabricating a cartridge including:

a body;

a printhead supported by the body, the printhead including an orifice plate having orifices formed therethrough;

an ink reservoir with a back pressure device disposed therein;

a standpipe defining a standpipe chamber for delivering ink from the reservoir to the printhead; and a filter adjacent the standpipe chamber for preventing contaminants in the ink from reaching the printhead;

introducing ink into the reservoir;

subjecting the cartridge to a predetermined centrifugal force to force ink away from the standpipe chamber to displace air in the reservoir to force the air to collect adjacent the standpipe; and priming the cartridge by drawing the air out of the cartridge through the orifices.

7. A method according to claim 6, wherein subjecting the cartridge to a predetermined centrifugal force includes:

supporting the cartridge a predetermined distance from a central point with an end of the body that supports the printhead closer to the central point; and rotating the cartridge at a predetermined speed to force ink away from the standpipe chamber so that air in the reservoir is displaced to collect adjacent the standpipe.

8. A method according to claim 7, wherein supporting the cartridge includes supporting the cartridge in a predetermined tilted position to allow rotating the cartridge to force ink clear of the filter.

9. A method according to claim 8, further including:

decelerating the cartridge to gradually bring the cartridge to rest while avoiding wetting of the screen filter by the ink.

10. A method according to claim 9, wherein supporting the cartridge includes supporting the cartridge in a manner to allow the cartridge to pivotably tilt between a rest position when at rest and an outwardly extending position when subjected to the centrifugal force.

11. A ink jet print cartridge comprising:

a body;

a printhead supported by the body, the printhead including an orifice plate having orifices formed therethrough;

an ink reservoir filled with a porous back pressure material;

a standpipe defining a standpipe chamber for delivering ink from the reservoir to the printhead;

a filter adjacent the standpipe chamber for preventing particulate contaminants in the ink from reaching the printhead; and ink contained in the ink reservoir;

wherein the cartridge is subjected to a predetermined centrifugal force to force the ink into the chamber to displace air trapped therein.

12. An ink jet cartridge according to claim 11, wherein the porous back pressure material is foam and wherein the foam further includes a gap formed therein that cordons off a portion of the foam adjacent the standpipe to allow the portion of the foam to retain ink forced thereto.

13. An ink jet cartridge according to claim 11, wherein the standpipe chamber is shaped such that air in the standpipe chamber is urged towards an edge of the standpipe chamber flanked by the filter to escape through the filter.

14. An ink jet cartridge according to claim 11, wherein the standpipe chamber is shaped such that air in the standpipe chamber is urged towards a corner of the standpipe chamber flanked by the filter to escape through the filter.

* * * * *